US009128436B2

(12) United States Patent
Komuro

(10) Patent No.: US 9,128,436 B2
(45) Date of Patent: Sep. 8, 2015

(54) FIXING DEVICE, AND IMAGE FORMING APPARATUS

(71) Applicant: FUJI XEROX CO., LTD., Tokyo (JP)

(72) Inventor: Hitoshi Komuro, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/964,293

(22) Filed: Aug. 12, 2013

(65) Prior Publication Data

US 2014/0294457 A1 Oct. 2, 2014

(30) Foreign Application Priority Data

Mar. 26, 2013 (JP) ..... 2013-065155

(51) Int. Cl.
*G03G 15/20* (2006.01)

(52) U.S. Cl.
CPC ..... *G03G 15/206* (2013.01); *G03G 15/2089* (2013.01)

(58) Field of Classification Search
CPC ..... G03G 15/2089; G03G 15/206
USPC ..... 399/329, 333
See application file for complete search history.

(56) References Cited

U.S. PATENT DOCUMENTS

| | | | | |
|---|---|---|---|---|
| 5,999,788 | A | 12/1999 | Kanesawa et al. | |
| 2004/0151515 | A1* | 8/2004 | Nakayama | 399/67 |
| 2009/0016790 | A1* | 1/2009 | Funabiki | 399/329 |
| 2011/0044737 | A1* | 2/2011 | Takada | 399/329 |
| 2011/0188910 | A1* | 8/2011 | Nakashima et al. | 399/333 |
| 2011/0206426 | A1* | 8/2011 | Komuro | 399/329 |
| 2012/0170958 | A1* | 7/2012 | Nakajima et al. | 399/333 |
| 2013/0051878 | A1* | 2/2013 | Ishikawa et al. | 399/329 |

FOREIGN PATENT DOCUMENTS

| | | |
|---|---|---|
| JP | A-11-133776 | 5/1999 |
| JP | A-2001-356625 | 12/2001 |

* cited by examiner

*Primary Examiner* — Rodney Bonnette
(74) *Attorney, Agent, or Firm* — Oliff PLC

(57) ABSTRACT

Provided is a fixing device including a rotatable rotating member, a tubular member that is movable while coming into contact with the rotating member, a pressure member that is arranged inside the tubular member and nips a recording medium holding an unfixed toner image at a nip portion formed between the rotating member and the tubular member by bringing the tubular member into pressure contact with the rotating member, to apply pressure for fixing the unfixed toner image on the recording medium, and a holding member that holds the pressure member, wherein the pressure member is made of an elastomer, and the end position of one surface of the elastomer that comes into contact with the tubular member is located further toward the upstream side in the transport direction of the recording medium than the end position of the other surface of the elastomer held by the holding member.

4 Claims, 6 Drawing Sheets

FIXING DEVICE, AND IMAGE FORMING APPARATUS

CROSS-REFERENCE TO RELATED APPLICATIONS

This application is based on and claims priority under 35 USC 119 from Japanese Patent Application No. 2013-065155 filed Mar. 26, 2013.

BACKGROUND (i) Technical Field

The present invention relates to a fixing device, and an image forming apparatus.

(ii) Related Art

In image forming apparatuses, such as a copying machine and a printer using electrophotography, a photoconductor (photoconductor drum) formed in the shape of, for example, a drum is uniformly charged, the photoconductor drum is exposed to controlled light based on the basis of image information, and an electrostatic latent image is formed on the photoconductor drum. After the electrostatic latent image is formed as a visible image (toner image) with toner and the toner image is transferred from the photoconductor drum to a recording paper, the toner image is fixed on the recording paper by a fixing device.

A fixing device 900 used for the image forming apparatus, as shown in FIG. 8, is constituted by a fixing roll 110 that includes a heating source 113 inside a cylindrical core and that is formed such that a heat-resistant elastomer layer 111 is laminated at the core and a release layer 112 is laminated at an outer circumferential surface, and a pressure roll 120 that is arranged so as to come into pressure contact with the fixing roll 110 and that is formed such that a heat-resistant elastomer layer 122 is laminated at a core 121 and a release layer 123 that is made of heat-resistant resin coating or heat-resistant rubber coating is laminated at an outer circumferential surface. A toner image is fixed on a recording medium (for example, recording paper) by passing the recording medium holding an unfixed toner image between the fixing roll 110 and the pressure roll 120 and performing heating and pressurization on the unfixed toner image. Such a fixing device is called a roll-nip type, a two-roll type, or a heating roller type, and is generally widely used.

Incidentally, when speed-up is attempted in the heating roll type fixing device, it is necessary to increase the nip width of a nip portion formed between the pressure roll and the fixing roll in proportion to a fixing speed so that a sufficient amount of heat may be supplied to the toner and the recording medium. As methods of increasing the nip width, there are a method of increasing the load between the fixing roll and the pressure roll, a method of increasing the thickness of the elastomer layer of the fixing roll, a method of increasing respective roll diameters, and the like.

However, in the method of increasing the load and the method of increasing thickness of the elastomer layer, the shape of the nip width resulting from deflection of the rolls may become nonuniform along a roll axis. Thus, uneven fixing may occur, creases may be generated on the recording medium, and problems may occur in terms of image quality. Additionally, in the method of increasing the diameter of the rolls, there are problems in that the enlargement of the apparatus is caused, and the time (warm-up time) until the temperature of the rolls is raised from a room temperature to a fixable temperature becomes long.

SUMMARY

According to an aspect of the present invention, there is provided a fixing device including: a rotatable rotating member; a tubular member that is movable while coming into contact with the rotating member; a pressure member that is arranged inside the tubular member and nips a recording medium holding an unfixed toner image at a nip portion formed between the rotating member and the tubular member by bringing the tubular member into pressure contact with the rotating member, to apply pressure for fixing the unfixed toner image on the recording medium; and a holding member that holds the pressure member, wherein the pressure member is made of an elastomer, and the end position of one surface of the elastomer that comes into contact with the tubular member on an inlet side of the nip portion in a transport direction of the recording medium is located further toward the upstream side in the transport direction of the recording medium than the end position of the other surface of the elastomer held by the holding member on the inlet side of the nip portion.

BRIEF DESCRIPTION OF THE DRAWINGS

Exemplary embodiments of the present invention will be described in detail based on the following figures, wherein.

DETAILED DESCRIPTION

A fixing device and an image forming apparatus in an exemplary embodiment of the invention will be described below.

Fixing Device

First, a fixing device in the present exemplary embodiment will be described with reference to FIG. 1. In addition, a configuration in which a heating and fixing roll that is a rotating member is disposed on a contact side with unfixed toner and an endless belt that is a tubular member, and a pressure member are disposed on the pressure side will be described in FIG. 1. However, a unit that heats the fixing roll may be a so-called external heating unit that performs heating from the outside of the fixing roll. Additionally, the heating unit may be on an endless-belt side. Additionally, an endless belt may be used as a fixing belt and be brought into contact with a toner surface on a recording medium, while the rotating member may be used as the pressure roll. In the subsequent description, the "heating and fixing roll" is simply referred to as a "fixing roll".

Figure 1:
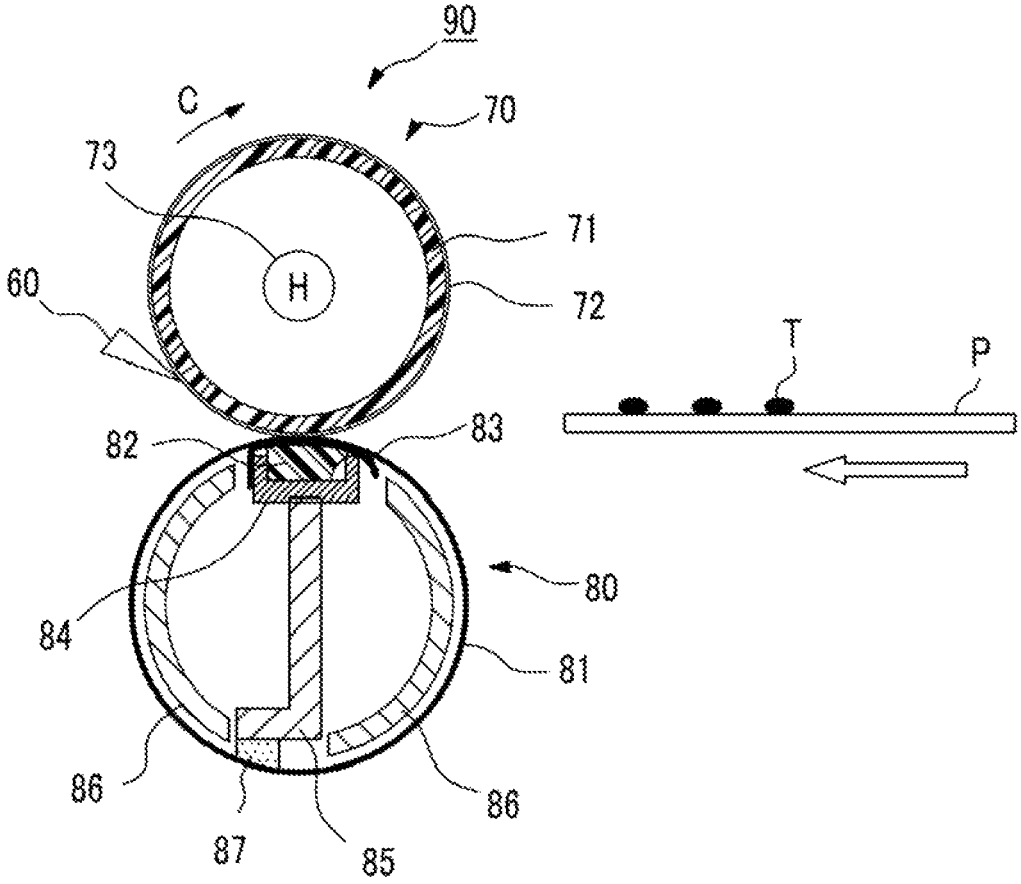
FIG. 1 is a schematic configurational view showing an example of the configuration of a fixing device in the invention.

Main portions of a fixing device 90 used for the image forming apparatus of the present exemplary embodiment, as shown in FIG. 1, are constituted by a fixing roll 70 as an example of the rotating member, and a pressure unit 80 including an endless belt 81 that is a tubular member, a pressure pad 82 that is a pressure member that is pressed from the fixing roll 70 via the endless belt 81, a holding member 84 holding the pressure pad 82, a sheet-like or cylindrical sliding member 83 provided between the endless belt 81 and the pressure pad 82, a guide member 86 that has a shape with an external diameter smaller than the internal diameter of the endless belt 81 that guides the inner surface of the endless belt 81, a lubricant supplying and cleaning member 87 that removes dirt on the inner surface of the endless belt 81 while supplying lubricant to the inner surface of the endless belt 81, and an intra-belt fixing and holding holder 85 that fixes the holding member 84 of the pressure pad 82 and the lubricant supplying and cleaning member 87.

On the other hand, the fixing roll 70 is configured such that a release layer 72 is laminated around a metallic core (cylindrical core) 71. Moreover, a halogen heater 73 as a heat generation source is arranged inside the fixing roll 70. Additionally, a temperature sensor (not shown) is arranged in contact with the surface of the fixing roll 70, a controller (not shown) of the image forming apparatus controls lighting of the halogen heater 73 on the basis of a temperature measurement value obtained by the temperature sensor, and performs adjustment so that the surface temperature of the fixing roll 70 maintains a preset temperature (for example, 160° C.).

More specifically, the endless belt 81 is rotatably supported by the pressure pad 82 arranged therein, a guide member 86 that guides traveling of the endless belt 81, and edge guides (not shown) arranged at both ends of the belt. Moreover, by bringing the fixing roll 70 into pressure contact with the endless belt 81, a nip portion is formed between the endless belt 81 and the fixing roll 70.

Moreover, the pressure pad 82 is arranged inside the endless belt 81 in a state where the pressure pad is pressed against the fixing roll 70 via the endless belt 81, and thereby, the nip portion is formed between the endless belt 81 and the fixing roll 70. Here, in order to secure a wide nip portion compared to the roll-nip type, the pressure pad 82 is made of an elastic member and is arranged on the holding member 84. Moreover, in order to make the sliding resistance between an inner peripheral surface of the endless belt 81 and the pressure pad 82 small, and the sliding member 83 made of, for example, a low-friction sheet is provided on at least the surface of the pressure pad 82 that comes into contact with the endless belt 81 in the nip portion.

Moreover, the guide member 86 that guides traveling of the endless belt 81 is attached to the intra-belt fixing and holding holder 85 and is configured so that the endless belt 81 rotates smoothly. Additionally, since the guide member 86 frictionally slides on the inner peripheral surface of the endless belt 81, the guide member is formed from materials with a low coefficient of static friction, and is formed from materials with low heat conductivity so that heat is not easily absorbed to the endless belt 81.

On the other hand, the fixing roll 70 rotates in the direction of a white arrow C by a drive motor (not shown), and the endless belt 81 also rotates so as to follow this rotation. A recording medium P to which a toner image T is electrostatically transferred in a transfer portion of the image forming apparatus is guided by a fixing entry guide (not shown) and is transported to the nip portion. When the recording medium passes through the nip portion, the toner image T on the recording medium P is fixed with pressure in the nip portion and heat supplied from the fixing roll 70.

Additionally, as an auxiliary unit for separation, a separation member 60 is arranged on the downstream side of the nip portion of the fixing roll 70.

Next, the shape and functions of the pressure pad 82 in the present exemplary embodiment will be described with reference to FIGS. 2 to 6.

Figure 4:
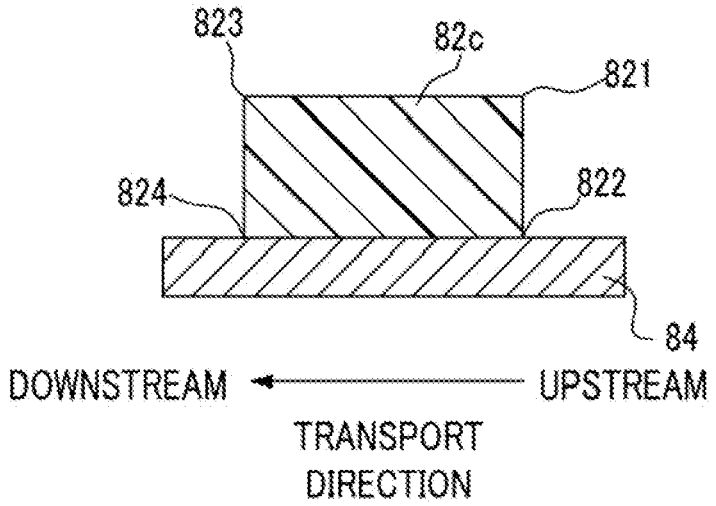
FIG. 4 is a cross-sectional view showing an example of the shape of a pressure pad made of an oblong member.

FIG. 4 shows an example of a pressure pad 82*c* made of an oblong member. Here, the right side of FIG. 4 is corresponding to an inlet side of the nip portion in a transport direction of the recording medium, while the left side of FIG. 4 is corresponding to an outlet side of the nip portion in the transport direction of the recording medium.

As shown in FIG. 4, a side 821 of the pressure pad 82*c* is an end portion that comes into contact with the endless belt on the inlet side (that is, the entry side of a recording medium) of the nip portion of the pressure pad 82*c*, and a side 822 of the pressure pad 82*c* is an inlet-side end portion of the nip portion of the pressure pad 82*c* held by the holding member 84. Moreover, the side 821 and the side 822 are located at the substantially same position in the transport direction of the recording medium.

Additionally, a side 823 of the pressure pad 82*c* is an end portion that comes into contact with the endless belt on the outlet side (that is, discharge and separation side of the recording medium) of the nip portion of the pressure pad 82*c*, and a side 824 of the pressure pad 82*c* is an outlet-side end portion of the nip portion of the pressure pad 82*c* held by the holding member 84. Moreover, the side 823 and the side 824 are located at the substantially same position in the transport direction of the recording medium.

Figure 6:
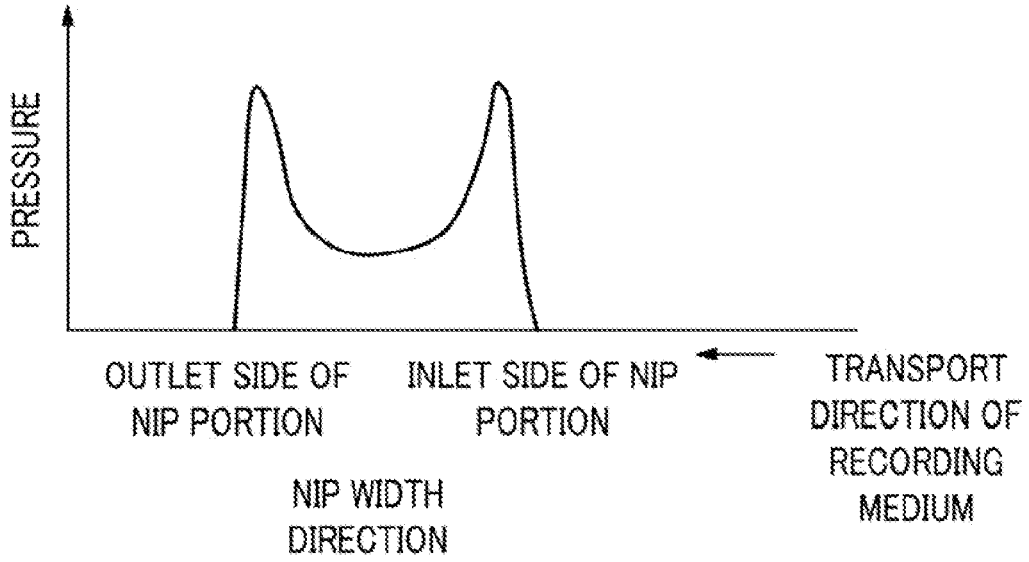
FIG. 6 is a schematic configurational view showing an example of pressure distribution in the nip width direction in the nip portion of the fixing device using the pressure member shown in FIG. 4.

The pressure distribution when the fixing roll 70 is pressurized using the pressure pad 82*c* with a shape shown in FIG. 4 to form a nip is shown in FIG. 6.

As shown in FIG. 6, as for the pressure distribution, the result shows that edge portions on the inlet side and outlet side of the nip becomes extremely high when the width direction (recording material passage direction) of the nip is defined as the horizontal axis. The result shows that this is a phenomenon that appears in a case where the elastic layer of the surface of the fixing roll 70 is thin compared to the pressure pad 82*c* with a shape of FIG. 4 or in the case of the fixing roll 70 that has no elastic layer to and has a release resin layer on the core. Since the pressure of the inlet side of the nip is high in the case of such pressure distribution, it is inferred that the recording medium does not easily enter the nip portion and the recording medium is easily influenced by an axial variation of a pressure holding position at the time of entry into the nip portion, and the behavior of the recording medium that enters from the near side of the nip portion fluctuates. It is inferred that creases are easily generated in the recording medium with fluctuation of the behavior of the recording medium and that deterioration of transportability caused by a great pressure drop after the inlet side of the nip portion is also observed.

Figure 2:
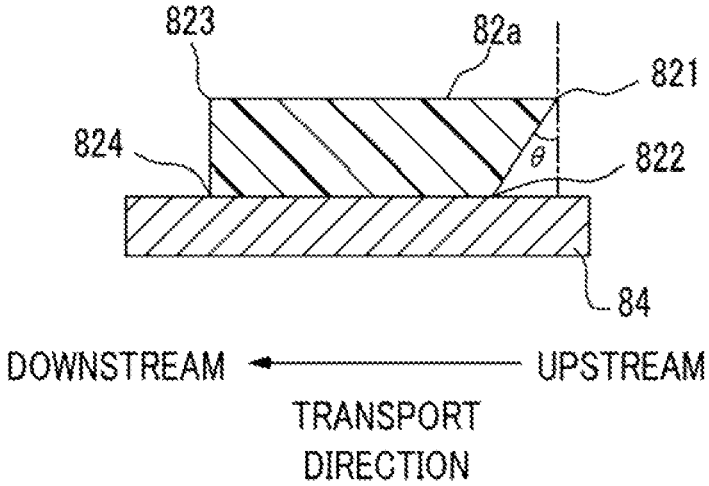
FIG. 2 is a cross-sectional view showing an example of the shape of a pressure pad that is a pressure member in the invention.

On the other hand, an example of the shape of the pressure pad 32*a* in the present exemplary embodiment is shown in FIG. 2. Here, the right side of FIG. 2 is corresponding to the inlet side of the nip portion in the transport direction of the recording medium, while the left side of FIG. 2 is corresponding to the outlet side of the nip portion in the transport direction of the recording medium.

As shown in FIG. 2, a side 821 of a pressure pad 82*a* is an end portion that comes into contact with the endless belt on the inlet side (that is, the entry side of a recording medium) of the nip portion of the pressure pad 82*a*, and a side 822 of the pressure pad 82*a* is an inlet-side end portion of the nip portion of the pressure pad 82*a* held by the holding member 84. Moreover, the position of the side 821 is located closer to the upstream side in the transport direction of the recording medium than the position of the side 822.

Additionally, a side 823 of the pressure pad 82*a* is an end portion that comes into contact with the endless belt on the outlet side (that is, discharge and separation side of the recording medium) of the nip portion of the pressure pad 82*a*, and a side 824 of the pressure pad 82*a* is an outlet-side end portion of the nip portion of the pressure pad 82*a* held by the holding member 84. Moreover, the side 823 and the side 824 are located at the substantially same position in the transport direction of the recording medium.

Figure 5:
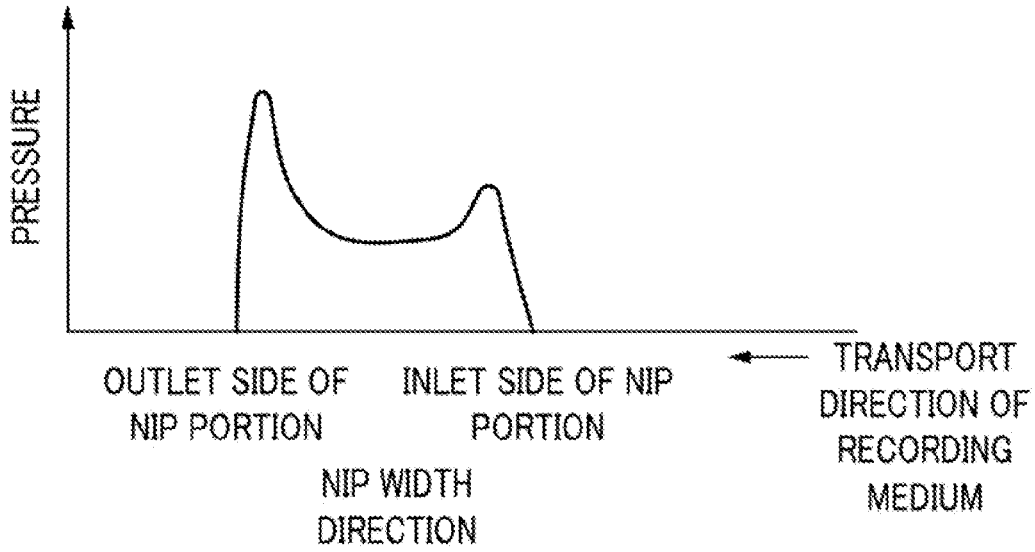
FIG. 5 is a schematic configurational view showing an example of pressure distribution in a nip width direction in a nip portion of the fixing device using the pressure member in the invention.

The pressure distribution when the fixing roll 70 is pressurized using the pressure pad 32*a* with a shape shown in FIG. 2 to form a nip is shown in FIG. 5.

In the case of the shape of the pressure pad 82*a* shown in FIG. 2, as for the pressure distribution, the pressure of an edge portion on the inlet side of the nip portion greatly drops compared to the pressure of an edge portion on the outlet side of the nip portion when the width direction (recording material passage direction) of the nip is defined as the horizontal axis. It is believed that this is caused by the fact that the degree of freedom in the deformation of the shape of the vicinity of the side 821 that is an end portion, on the recording medium entry side, of the surface of the pressure pad 82*a* that comes into contact with the nip portion increases and as a result, the pressure pad 82*a* on the inlet side of the nip portion deforms easily with respect to pressurization in the nip portion. Accordingly, the entry of the recording medium into the nip portion also becomes easy compared to the shape of the pressure pad 82*c* of FIG. 4 and is not easily influenced by the axial variation of the pressure holding position at the time of entry of the recording medium. As a result, it is inferred that the behavior of the recording medium that enters from the near side of the inlet of the nip portion is stabilized, and thereby, generation of creases is suppressed that the pressure differential between the pressure on the inlet side of the nip portion and the pressure after the inlet side of the nip portion becomes small, and thereby, the transportability of the recording medium within the nip portion is improved.

On the other hand, as the side 823 and the side 824 of the pressure pad 82*a* are arranged in a substantially vertical direction, as in the pressure distribution shown in FIG. 5, the pressure becomes high on the outlet side of the nip portion, and the separability of the recording medium on which a toner image is fixed becomes high.

Here, in the pressure pad 82*a* in FIG. 2, a right side surface of the oblong member is cut obliquely at an angle θ. The oblique cutting plane may be a planar surface or a curved surface. Additionally, although the angle θ is appropriately selected in consideration of the degree of freedom in deformation and durability with respect to the material quality of the pressure pad and the load of the nip portion, approximately 1° to 60° are preferable, and approximately 15° to 50° are more preferable.

Additionally, another example of the shape of the pressure pad in the present exemplary embodiment is shown in FIG. 2. Here, the right side of FIG. 3 is corresponding to the inlet side of the nip portion in the transport direction of the recording medium, while the left side of FIG. 3 is corresponding to the outlet side of the nip portion in the transport direction of the recording medium.

Figure 3:
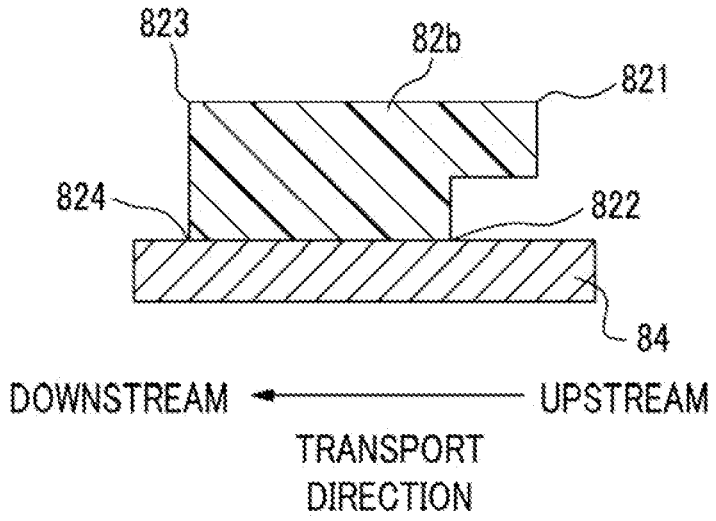
FIG. 3 is a cross-sectional view showing another example of the shape of the pressure pad that is the pressure member in the invention.

As shown in FIG. 3, a side 321 of a pressure pad 82*b* is an end portion that comes into contact with the endless belt on the inlet side (that is, the entry side of a recording medium) of the nip portion of the pressure pad 82*b*, and a side 822 of the pressure pad 82*b* is an inlet-side end portion of the nip portion of the pressure pad 82*b* held by the holding member 84. Moreover, the position of the side 821 is located closer to the upstream side in the transport direction of the recording medium than the position of the side 822. Additionally, the pressure pad 82*b* shown in FIG. 3 has a shape in which a lower portion of a right side surface of the oblong member corresponding to the inlet side of the nip portion is partially cut away to a whole contact surface with the holding member 84, and the contact area between the pressure pad 82*b* and the endless belt is greater than the holding area between the pressure pad 82*b* and the holding member 84. Here, the volume of the partially cut-away portion of the lower portion in the pressure pad 82*b* is appropriately selected in consideration of the degree of freedom in deformation and durability with respect to the material quality of the pressure pad and the load of the nip portion.

In addition, the side 823 and the side 824 of the pressure pad 82*b* are located at the substantially same position in the transport direction of the recording medium, and the pressure distribution when the fixing roll 70 is pressurized using the pressure pad 82*b* with a shape shown in FIG. 3 to form a nip is substantially the distribution shown in FIG. 5.

Figure 9:
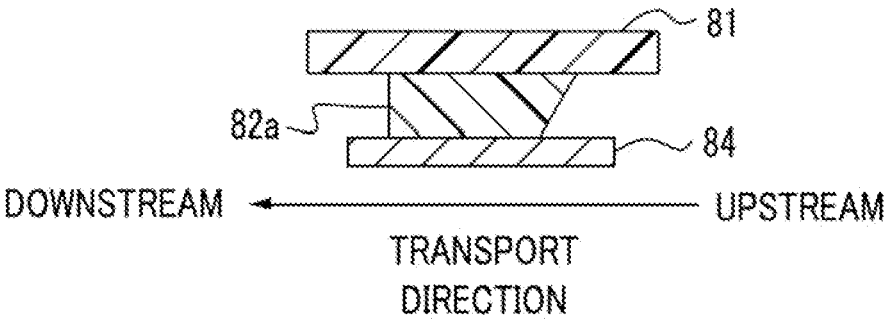
FIG. 9 is a schematic view describing an example of the positional relationship among the pressure pad that is the pressure member in the invention, a holding member, and an endless belt that is a tubular member.
Figure 10:
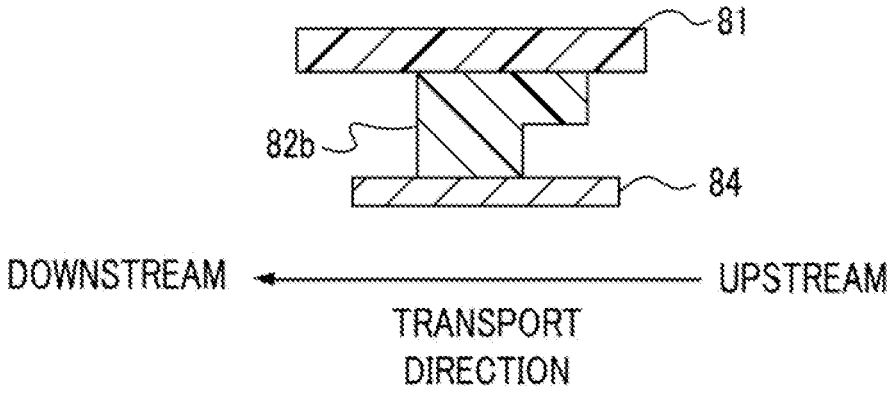
FIG. 10 is a schematic view describing another example of the positional relationship among the pressure pad that is the pressure member in the invention, the holding member, and the endless belt that is the tubular member.
Figure 11:
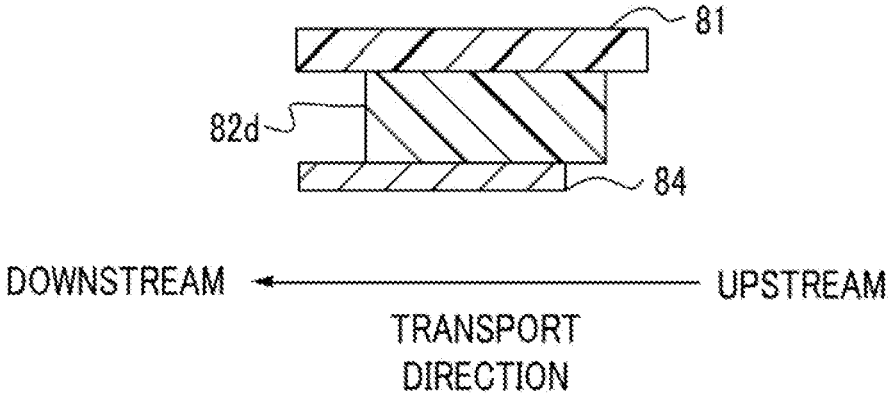
FIG. 11 is a schematic view describing another example of the positional relationship among the pressure pad that is the pressure member in the invention, the holding member, and the endless belt that is the tubular member.

In the fixing device in the present exemplary embodiment, as further shown in FIGS. 9 to 11, a position located on the upstream side in the transport direction of the recording medium, where the holding member 84 applies pressure to the pressure pad 82*a*, 82*b*, or 82*d* that is a pressure member is located further toward the downstream side than a most upstream position where the pressure pad 82*a*, 82*b*, or 82*d* that is a pressure member comes into contact with the endless belt 81 that is a tubular member.

Next, respective members that constitute the fixing device will be described.

Figure 8:
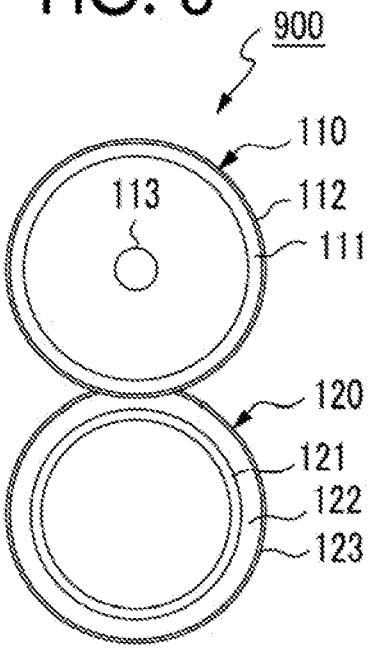
FIG. 8 is a schematic configurational view showing an example of the configuration of a roll-nip type fixing device.

First, in the fixing roll 70, the core (base material) 71 is constituted by a cylindrical member formed from metals with high heat conductivity, such as iron, aluminum, and SUS. As for the external diameter and thickness of the core 71, in the fixing device of the present exemplary embodiment, diameter reduction and thickness reduction are plotted more than the roll fixing device shown in FIG. 8 in order to make the pressing force of the pressure pad 82 small and secure a predetermined nip width in the nip portion. Usually, the external diameter is about from 15 mm to 50 mm, and although depending on materials, the thickness is about from 1 mm to 3 mm in the case of aluminum and is about from 0.4 mm to 1.5 mm in the case of SUS or iron.

Any kind of resin may be used for the release layer 72 if the resin is heat-resistant resin. For example, silicone resins, fluororesins, or the like is used, but the fluororesins are suitable from viewpoints of releasability and wear resistance with respect to toner of the release layer 72. As the fluororesins, there are used a tetrafluoroethylene-perfluoroalkylvinyl ether copolymer (PFA), polytetrafluoroethylene (PTFE), and a tetrafluoroethylene-hexafluoropropylene copolymer (FEP), composite materials thereof, or those obtained by blending fillers, such as silicon carbide, alumina, and barium sulfate, with these resins. As the thickness of the release layer 72, from viewpoints of thermal conductivity, manufacturing costs, and durability, 5 μm to 50 μm are preferable and 10 μm to 40 μm is more preferable.

The endless belt 81 is an endless belt with no joint, whose original shape is formed in a cylindrical shape with a diameter from 15 mm to 40 mm so that any defect resulting from the joint is not generated in an output image, and is constituted by a base layer, and release layers coated on the surface of this base layer on the fixing roll 70 side or on both surfaces of the belt. The base layer is formed from polymers, such as polyimide, polyamide, and polyimide amide, or thin film metals, such as SUS and a nickel alloy, and the thickness of the base layer is about from 30 μm to 200 μm, preferably about from 40 μm to 125 μm, and more preferably about from 50 μm to 100 μm in the case of the polymers, and about from 10 μm to 100 μm and preferably about from 20 μm to 50 μm in the case of the thin film metals. The release layer coated on the surface of the base layer are formed from fluororesins, for example, PFA, PTFE, FEP, composite materials thereof, or those obtained by blending fillers, such as carbon, alumina, and barium sulfate, with these resins, and the thickness thereof is about from 5 μm to 100 μm and preferably about from 10 μm to 40 μm.

The pressure unit 80, as described above, is constituted by the pressure pad 82 and the holding member 84, and the holding member 84 is supported by the intra-belt fixing and holding holder 85.

As the pressure pad 82, heat-resistant rubber, such as silicone rubber and fluororubber, is used. The holding member 84 may be formed from materials with rigidity that may support the pressure pad 82, and is formed from heat-resistant resins, such as polyphenylene sulfide (PPS), or metallic materials, such as and SUS and aluminum.

Although a contact surface with the endless belt is pressurized by the pressure pad 82, the materials of the pressure pad 82 are materials with poor slidability, such as rubber, as mentioned above. In order to compensate for this, the sliding member 83 made of a low-friction sheet is provided between the inner peripheral surface of the endless belt 81 and the pressure pad 82 to reduce the sliding resistance (frictional resistance) of both. Here, as the materials of the sliding member 83, materials are suitable that make the frictional coefficient of a sliding surface between the inner peripheral surface of the endless belt 81 and the pressure pad 82 small and are excellent in wear resistance and heat resistance. Specifically, a PTFE resin sheet that is sintering-molded, a glass fiber sheet in which a fluororesin is impregnated, a laminated sheet in which a film sheet made of a fluororesin is heated and welded to a glass fiber and sandwiched, and the like are used.

Additionally, since the guide member 86 frictionally slides on the inner peripheral surface of the endless belt 81 as described above, materials, which have a low frictional coefficient and have low heat conductivity so that heat is not easily taken from the endless belt 81, are suitable, and heat-resistant resins, such as PFA and PPS, are used.

The intra-belt fixing and holding holder 85 is provided over a major axis of the endless belt 81, has the pressure pad 32 and the holding member 84 provided at one end, and has the lubricant supplying and cleaning member 87 provided at the other end. The lubricant supplying and cleaning member 87 is arranged so as to come into contact with the inner peripheral surface of the endless belt 81, and supplies an appropriate amount of lubricant, such as amino-modified silicone oil and fluorine oil, to the inner peripheral surface of the endless belt 81. Accordingly, lubricant is supplied to a sliding portion between the endless belt 81 and the sliding member 83, the sliding resistance in the nip portion of the endless belt 81 via the sliding member 83 is further reduced, and smooth rotation of the endless belt 81 is promoted.

In addition, a case where the pressure pad 82 that is a pressure member is one has been described in the present exemplary embodiment, the nip portion may be formed by plural pressure pads. In the case of the plural pressure pads, the hardness of elastic materials of the respective pressure pads may be changed.

[Image Forming Apparatus]

Figure 7:
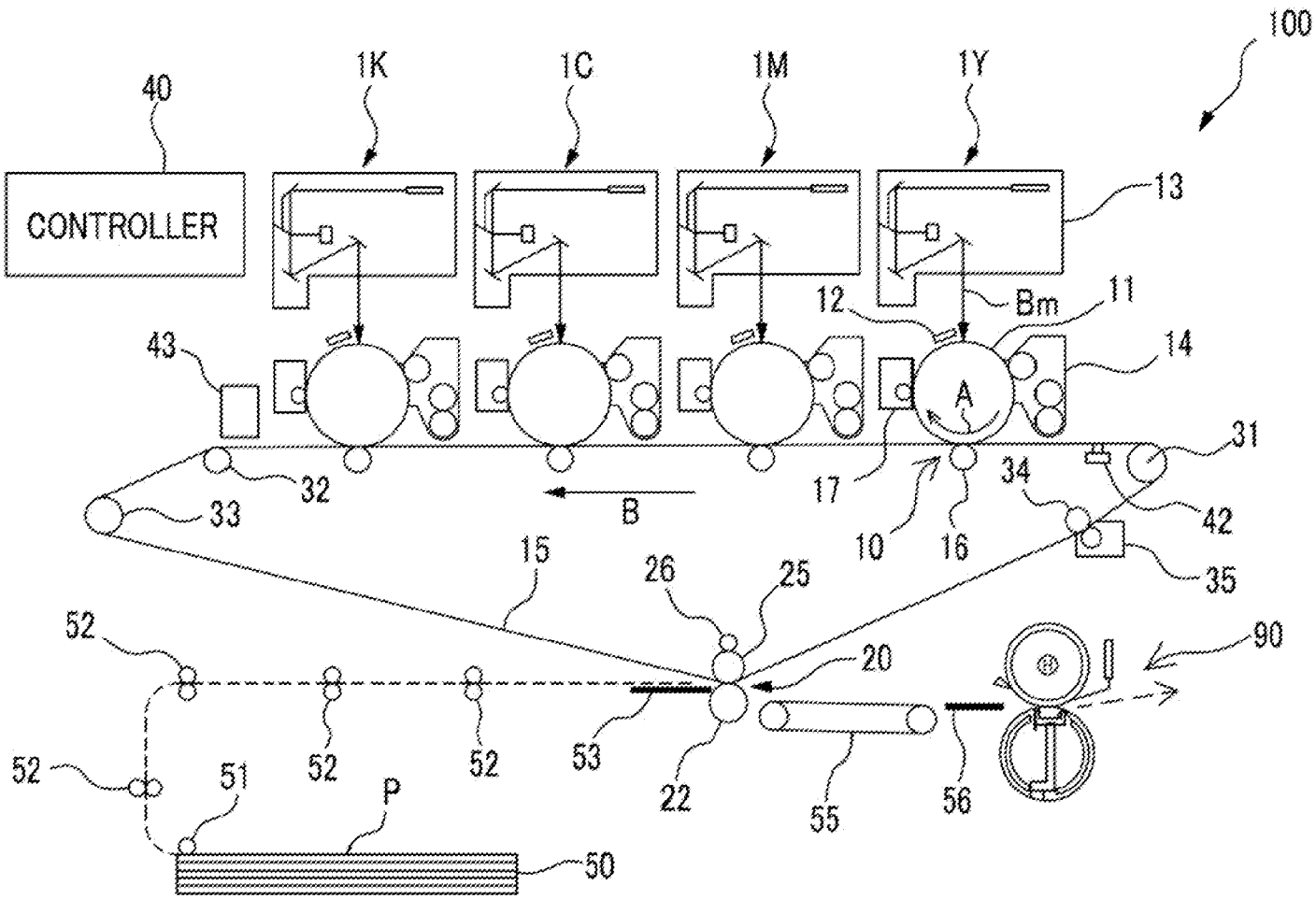
FIG. 7 is a schematic configurational view showing an example of the configuration of an image forming apparatus in the invention.

A schematic configuration of an image forming apparatus to which the sliding sheet and fixing device of the present exemplary embodiment are applied is shown in FIG. 7. Here, an image forming apparatus of an intermediate transfer type generally called a tandem type will be described as an example.

The image forming apparatus 100 shown in FIG. 7 includes plural image forming units 1Y, 1M, 1C, and 1K that form respective color component toner images of by electrophotography, as an example of an image forming section composed of a latent image forming unit and a developing unit. Next, the image forming apparatus 100 includes, as an example of a transfer unit, a primary transfer portion 10 that sequentially transfers (primarily transfers) the respective color component toner images, which are formed by the respective image forming units 1Y, 1M, 1C, and 1K, to an intermediate transfer belt (image holding member) 15, and a secondary transfer portion 20 that collectively transfers (secondarily transfers) a superposed toner image transferred onto the intermediate transfer belt 15 to a sheet that is a recording medium P (recording material (transfer target)). Moreover, the image forming apparatus 100 includes, as an example of a fixing unit, the above-described fixing device 90 that fixes the secondarily transferred image on the recording medium P. Additionally, the image forming apparatus 100 includes the controller 40 that controls the operation of the respective devices (respective sections).

As shown in FIG. 7, each of the image forming units 1Y, 1M, 1C, and 1K has a photoconductor drum 11 that rotates in the direction of arrow A, a charger 12 that charges the photoconductor drum 11, a laser exposure unit 13 that writes an electrostatic latent image on the photoconductor drum 11, and a developer unit 14 that contains each color component toner and forms the electrostatic latent image on the photoconductor drum 11 as a visible image with toner. Additionally, each image forming unit has a primary transfer roll 16 that transfers each color component toner image formed on the photoconductor drum 11 to the intermediate transfer belt 15 in the primary transfer portion 10, and a drum cleaner 17 that removes residual toner on the photoconductor drum 11. The image forming units 1Y, 1M, 1C, and 1K are arranged substantially linear in order of yellow (Y), magenta (M), cyan (C), and black (K) from the upstream side of the intermediate transfer belt 15.

The intermediate transfer belt 15 is circularly driven in the direction of arrow B shown in FIG. 7 by various rolls. The various rolls has a drive roll 31 that drives the intermediate transfer belt 15, a support roll 32 that supports the intermediate transfer belt 15, a tension roll 33 that applies constant tension to the intermediate transfer belt 15 to prevent meandering, a backup roll 25 that is provided at the secondary transfer portion 20, and a cleaning backup roll 34 that is provided at a cleaning section that scrapes off the residual toner on the intermediate transfer belt 15.

The primary transfer portion 10 has the primary transfer roll 16 that faces the photoconductor drum 11 across the intermediate transfer belt 15. The secondary transfer portion 20 includes a secondary transfer roll (transfer member) 22 that is arranged on a toner image holding surface side of the intermediate transfer belt 15, a backup roll 25 that is arranged on a rear surface side of the intermediate transfer belt 15 as a counter electrode of the secondary transfer roll 22, and a power feed roll 26 that applies a secondary transfer bias to the backup roll 25.

An intermediate transfer belt cleaner 35 that removes residual toner or paper debris on the intermediate transfer belt 15 is provided on the downstream side of the secondary transfer portion 20. A reference sensor (home position sensor) 42 that generates a reference signal for taking an image formation timing in each of the image forming units 1Y, 1M, 1C, and 1K is disposed on the upstream side of the image forming unit 1Y for yellow. Additionally, an image density sensor 43 for performing adjustment of image quality is disposed on the downstream side of the image forming unit 1K for black.

A recording medium transport system has a recording medium accommodating section 50, a pickup roll 51 that takes out and transports a recording medium P in the recording medium accommodating section 50, a transport roll 52 that transports the recording medium P, a transport chute 53 that feeds the recording medium P to the secondary transfer portion 20, a transport belt 55 that transports the recording medium P secondarily transferred by the secondary transfer roll 22 to the fixing device 90, and the fixing entry guide 56 that guides the recording medium P to the fixing device 90.

A basic image forming process of the image forming apparatus 100 will be described. In the image forming apparatus 100 as shown in FIG. 7, after image processing is performed on image data output from an image reader (not shown) or the like, the image data is converted into color material gradation data in four colors of Y, M, C, and K, and is output to the laser exposure units 13. The laser exposure units 13 irradiate the respective photoconductor drums 11, which rotate in the direction of arrow A, of the image forming units 1Y, 1M, 1C, and 1K with, for example, exposure beams Bm emitted from semiconductor lasers according to the input color material gradation data. After the surfaces of the respective photoconductor drums 11 are charged by the chargers 12, the surfaces are scanned and exposed by the laser exposure units 13 to form electrostatic latent images. The formed electrostatic latent images are developed as toner images in respective colors of Y, M, C, and K by the respective image forming units 1Y, 1M, 1C, and 1K.

Next, the toner images formed on the photoconductor drums 11 are sequentially superposed on the surface of the intermediate transfer belt 15 in the primary transfer portion 10 and are subjected to the primary transfer. The intermediate transfer belt 15 moves in the direction of arrow B, and transports the toner images to the secondary transfer portion 20. The recording medium transport system supplies the recording medium P from the recording medium accommodating section 50 according to a timing at which the superposed toner image is transported to the secondary transfer portion 20. In the secondary transfer portion 20, an unfixed toner image held on the intermediate transfer belt 15 is electrostatically transferred onto the recording medium P nipped between the intermediate transfer belt 15 and the secondary transfer roll 22. Thereafter, the recording medium P to which the toner image is electrostatically transferred is transported up to the fixing device 90 by the transport belt 55, and the fixing device 90 processes the unfixed toner image on the recording medium P with heat and pressure, and fixes the unfixed toner image on the recording medium P. The recording medium P on that the fixed image is formed is transported to an ejected sheet placing portion provided at an ejection section of the image forming apparatus.

EXAMPLES

Hereinafter, although the invention will be described in more detail according to Examples, the invention is not limited to the following Examples. Additionally, evaluation described in the following a manufacture example, the examples, and a comparative example is carried out by the following method.

Evaluation Method

In the fixing device shown in FIG. 1, the surface pressure between the endless belt 81 and the fixing roll 70 is usually set to from 0.15 MPa to 0.3 MPa. Thus, in the following evaluation, the surface pressure is set to 0.35 MPa higher than a normal surface pressure, a sheet is passed at 0.07 m/s slower than a normal sheet passage speed (0.2 m/S), a regular paper ("Ncolor104 ZGAAO239": made by Fuji Xerox) is used as a recording medium, and the absence/presence of any crease after double-sided printing of 20 sheets under conditions severer than those at normal printing is visually checked.

Example 1

In a JIS K 7312 soft rubber hardness testing method, the pressure pad 82*a* with a shape shown in FIG. 2 that is made of silicone rubber of 20° Hc in terms of C hardness is manufactured. In Example 1, a right side surface of the rubber that is an oblong member is obliquely cut such that the angle θ becomes 30 degrees.

Example 2

In a JIS K 7312 soft rubber hardness testing method, the pressure pad 82*b* with a shape shown in FIG. 3 that is made of silicone rubber of 30° He in terms of C hardness is manufactured. In Example 2, molding is made such that a lower portion, corresponding to ½ of rubber thickness, of the right side surface of the rubber that is the oblong member is cut away and the ratio of the contact area between the pressure pad 82*b* and the endless belt and the holding area between the pressure pad 82*b* and the holding member 84 becomes 7:5.

Reference Example

In a JIS K 7312 soft rubber hardness testing method, the pressure pad 82*c* of a rectangular parallelepiped shown in FIG. 4 that is made of silicone rubber of 20° Hc in terms of C hardness is manufactured.

The results obtained by evaluating Examples 1 and 2 and Reference Example on the basis of the above-described evaluation method are shown in Table 1.

TABLE 1

| | Shape of Pressure Pad | Presence/absence of Crease |
|---|---|---|
| Example 1 | FIG. 2 | None |
| Example 2 | FIG. 3 | None |
| Reference Example | FIG. 4 | Generation of crease is checked on second sheet |

As application examples of the invention, there are applications to image forming apparatuses, such as a copying machine and a printer using electrophotography.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a rotatable rotating member;

a tubular member that is movable while coming into contact with the rotating member;

a pressure member that is arranged inside the tubular member and nips a recording medium holding an unfixed toner image at a nip portion formed between the rotating member and the tubular member by bringing the tubular member into pressure contact with the rotating member, to apply pressure for fixing the unfixed toner image on the recording medium, the pressure member including an end having a slanted configuration or a stepwise configuration; and a holding member that holds the pressure member, wherein the pressure member is made of an elastomer, and the end position of one surface of the elastomer that comes into contact with the tubular member on an inlet side of the nip portion in a transport direction of the recording medium is located further toward the upstream side in the transport direction of the recording medium than the end position of the other surface of the elastomer held by the holding member on the inlet side of the nip portion, and wherein in the pressure member, the end position of one surface of the elastomer that comes into contact with the tubular member on an outlet side of the nip portion in the transport direction of the recording medium and the end position of the other surface of the elastomer held by the holding member on the outlet side of the nip portion are arranged at a same position in the transport direction of the recording medium.

2. The fixing device according to claim 1, wherein the rotating member includes a releasable resin layer as at least a surface layer of a metallic core, and does not includes an elastic layer between the surface layer and the core.

3. An image forming apparatus comprising:

a latent image forming unit that forms a latent image on an image holding member;

a developing unit that develops the latent image using developer for developing an electrostatic image;

a transfer unit that transfers the developed toner image onto a transfer target with or without interposition of an intermediate transfer body; and a fixing unit that fixes the toner image on the transfer target, wherein the fixing unit is the fixing device according to claim 1.

4. A fixing device comprising:

a rotatable rotating member;

a tubular member that is movable while coming into contact with the rotating member;

a pressure member that is arranged inside the tubular member and is made of an elastomer, the pressure member including an end having a slanted configuration or a stepwise configuration; and a holding member that nips a recording medium holding an unfixed toner image at a nip portion formed between the rotating member and the tubular member by bringing the tubular member into pressure contact with the rotating member via the pressure member, to apply pressure for fixing the unfixed toner image on the recording medium to the pressure member, wherein a most upstream position in the transport direction of the recording medium, where the holding member applies pressure to the pressure member is located further toward the downstream side than a most upstream position where the pressure member comes into contact with the tubular member, and wherein the pressure member is made of an elastomer and in the pressure member, the end position of one surface of the elastomer that comes into contact with the tubular member on an outlet side of the nip portion in the transport direction of the recording medium and the end position of the other surface of the elastomer held by the holding member on the outlet side of the nip portion are arranged at a same position in the transport direction of the recording medium.

* * * * *